United States Patent [19]

Wu

[11] Patent Number: 4,999,858

[45] Date of Patent: Mar. 19, 1991

[54] FLOOR DRAIN PIPE WITH IMPROVED STRAINING STRUCTURE

[76] Inventor: Chih-Cheng Wu, F 3, No. 568-2, Ching Ping Rd., Chung Ho City, Taipei Hsien, Taiwan

[21] Appl. No.: 496,849

[22] Filed: Mar. 21, 1990

[51] Int. Cl.[5] ..... E03C 1/26

[52] U.S. Cl. ..... 4/288; 4/286; 4/290; 4/292; 15/104.33

[58] Field of Search ..... 4/286–287, 4/289, 257, 292, DIG. 14, 288; 15/104.33

[56] References Cited

U.S. PATENT DOCUMENTS

| | | | |
|---|---|---|---|
| 594,169 | 11/1897 | Cotsiff | 4/DIG. 14 |
| 774,953 | 11/1904 | Rieker | 4/257 |
| 1,886,676 | 11/1932 | Heucker | 4/257 X |
| 1,935,128 | 11/1933 | Pullman | 4/286 |
| 2,424,932 | 7/1947 | Juhasz | 4/DIG. 14 X |
| 2,506,669 | 5/1950 | Heucker | 4/292 |
| 2,690,569 | 10/1954 | Kozerski | 4/292 |
| 4,051,042 | 9/1977 | Tullier et al. | 4/292 X |
| 4,164,048 | 8/1979 | Kampfer et al. | 4/292 |

*Primary Examiner*—Henry K. Artis

[57] ABSTRACT

A drain pipe assembly, which includes a S-shaped drain pipe having mounted on its orifice a cup-like filter plate and a strainer and having inserted therein a cleaning brush. The S-shaped drain pipe includes a bent pipe portion extending from a vertical end pipe portion to define therewith a first bent on its upper side and a second bent on its bottom side, wherein the second bent is arranged at a level much higher than the first bent so that impurities and mud carried by rain water can be retained in the bottom of the vertical end pipe portion and vermin can be prohibited from passing therethrough. The cleaning brush can be pulled up and pushed down repeatedly to shack off the sediments accumulated thereon and clear the passage way of the boring bore of the drain pipe to prevent against block-up

3 Claims, 3 Drawing Sheets

For sale by Superintendent of Documents, U.S. Government Printing Office, Washington, DC 20402.

FLOOR DRAIN PIPE WITH IMPROVED STRAINING STRUCTURE

BACKGROUND OF THE INVENTION

The present invention is related to floor drain pipes and more particularly to a floor drain pipe which has an improved straining structure to protect the pipe against block-up.

Regular drain pipes are generally mounted with a strainer to prevent miscellaneous objects from entering a pipe. Because a strainer is generally to filter out bigger objects and can not prevent mud, grains and other tiny impurities from entering a pipe, a drain pipe may be blocked up easily by sediments after a certain period of time in use. If a drain pipe is blocked up, it is very difficult to clear the passage way of such a drain pipe. The use of any strong acidic chemicals for clearing the passage way of a drain pipe is very dangerous and the chemicals must be carefully kept out of the reach of children to avoid accidents. However, this is just to scope with symptoms only and can not treat the matter thoroughly. It is therefore, the idea of the present inventor to design a floor drain pipe which can efficiently eliminate the said problems and thereby prevent drain pipe block-up.

SUMMARY OF THE INVENTION

The present invention is to provide a floor drain pipe assembly which includes a cleaning brush inserted in a S-shaped drain pipe and secured to a straining device which is mounted on the orifice of such a S-shaped drain pipe, which cleaning brush includes an elongated flexible board having a plurality of lines of cross-wise arranged projecting strips. By means of pulling and pushing the cleaning brush repeatedly up and down, the sediments in the S-shaped drain pipe can be efficiently cleaned and the passageway of the drain pipe is protected against block-up.

Another feature of the drain pipe assembly of the present invention is the S-shaped drain pipe which includes a bent pipe portion extending from a vertical end pipe portion to define therewith a first bent on its upper side and a second bent on its bottom side, wherein the second bent is arranged at a level much higher than the first bent so that impurities and mud contained in the drain water which flows therein can be retained in the bottom of the vertical end pipe portion and vermins can be prohibited from passing therethrough.

BRIEF DESCRIPTION OF THE DRAWINGS

The present invention will now be described by way of example with reference to the annexed drawings, in which.

DETAILED DESCRIPTION OF THE INVENTION

Figure 1:
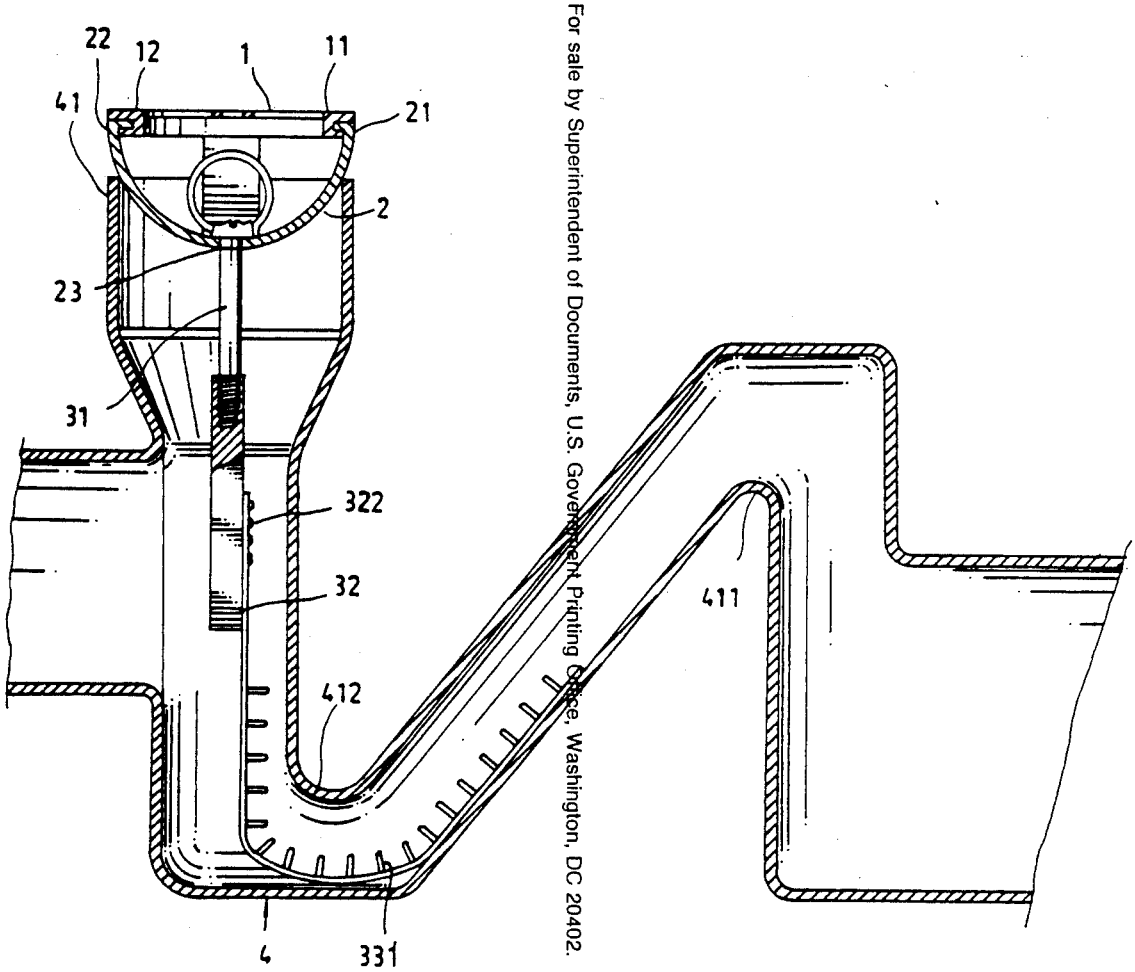
FIG. 1 is a longitudinal sectional view of the present invention.
Figure 2:
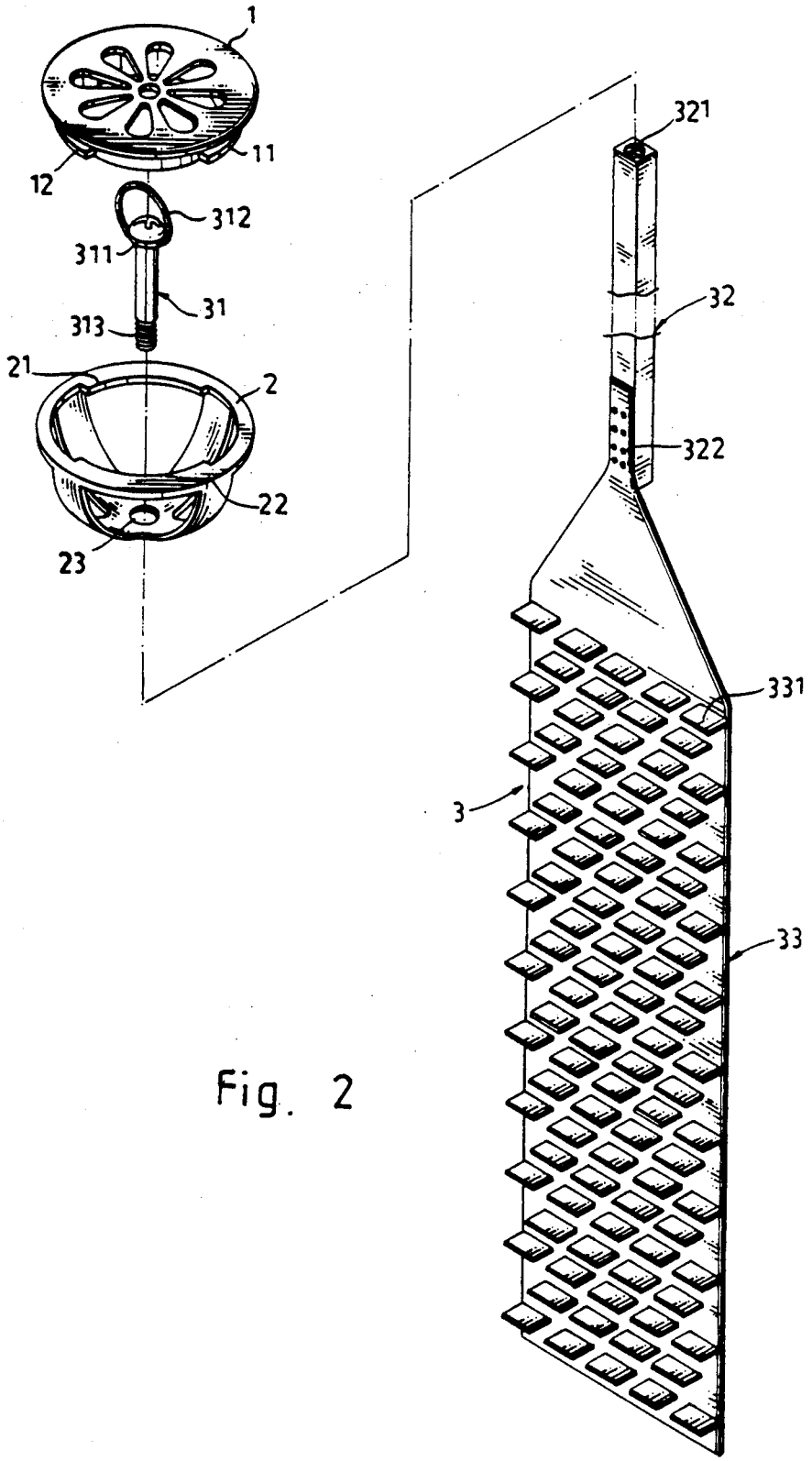
FIG. 2 is a perspective fragmentary view of the present invention.
Figure 3:
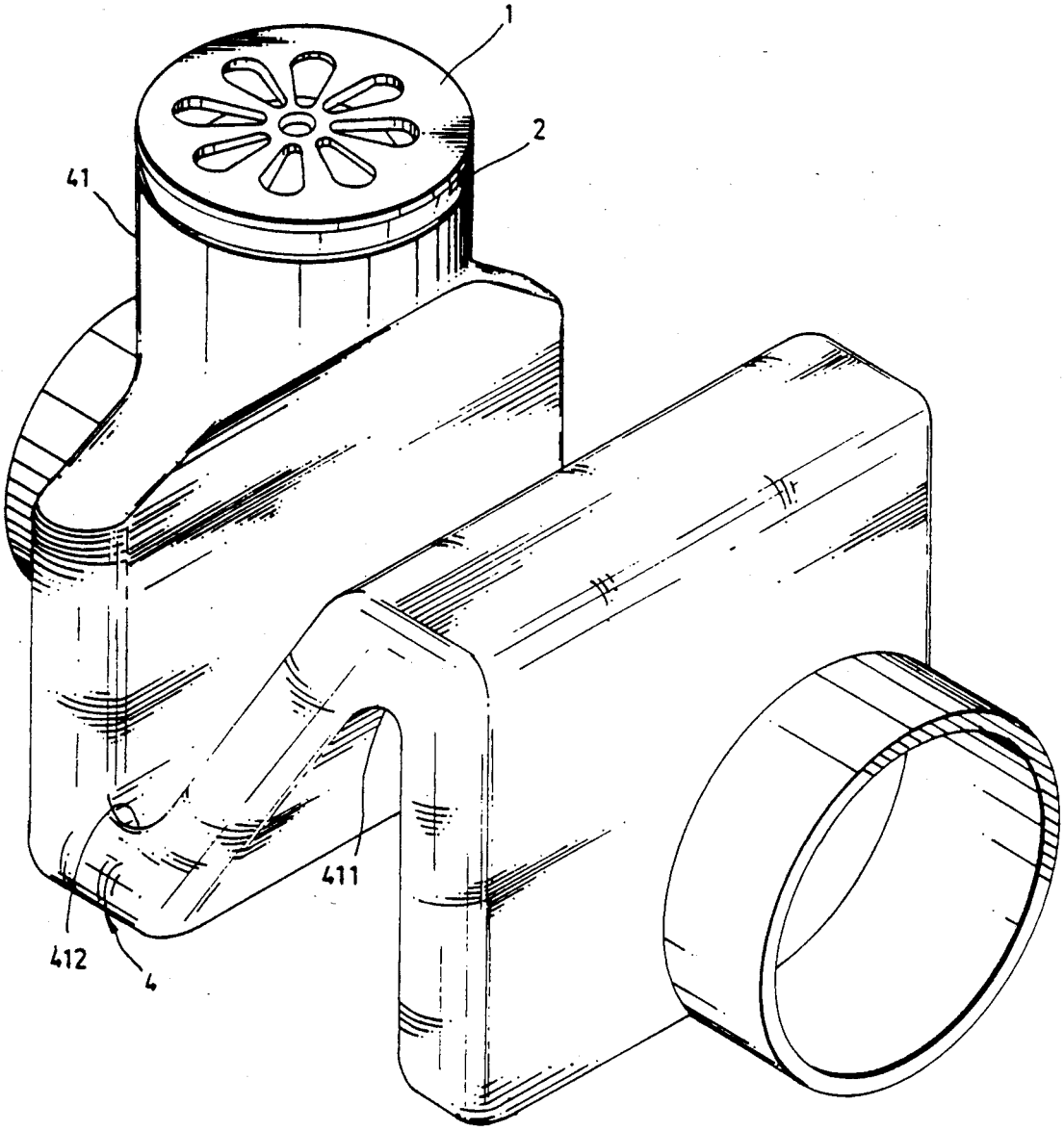
FIG. 3 is a perspective view schematic drawing of the present invention.

Referring to the annexed drawings in greater detail, a floor drain pipe in accordance with the present invention is generally comprised of a strainer (1), a cup-like filter plate (2), a cleaning brush (3) and a S-shaped drain pipe (4). The cup-like filter plate (2) has two opposite inward projections (21), (22) defining therewith two opposite recessed portions such that the two side projections (11), (12) of the strainer (1) can be inserted through the two opposite recessed portions and turned to the bottom of the two opposite inward projections (21), (22) permitting the strainer (1) to be firmly retained by the cup-like filter plate (2). The S-shaped drain pipe (4) includes a bent pipe portion extending from a vertical end pipe portion to define therewith a first bent (412) on its upper side and a second bent (411) on its bottom side, wherein the second bent (411) is arranged at a level much higher than the first bent (412) so that impurities and mud contained in the drain water which flows therein can be retained in the bottom of the vertical end pipe portion and vermin can be prohibited from passing therethrough. The cup-like filter plate (2) is mounted on the top opening of the vertical end pipe portion of the S-shaped drain pipe (4) for holding the strainer (1) on its top and the cleaning brush (3) on its bottom. The cleaning brush (3) is comprised of a pull rod (31) having a threaded bottom end (313), a top head (311) and a lifting ring (312); a link rod (32) having a bolt hole (321) on the top, and a plurality of side pins (322) at one side; and an elongated flexible board (33) having made thereon a plurality of lines of cross-wise arranged projecting strips (331), wherein the elongated flexible board (33) is secured to the side pins (322) of the link rod (32) and the threaded bottom end (313) of the pull rod (31) is fastened in the bolt hole (321) of the link rod (32).

When in use, the cup-like filter plate (2) is mounted on the top opening of the vertical end pipe portion of the S-shaped drain pipe (4), the strainer (1) is retained in the cup-like filter plate (2), and the cleaning brush (3) is secured to the cup-like filter plate (4) and inserted in the S-shaped drain pipe (4) to attach to the inner wall surface thereof with its projecting strips projecting in the passage of the S-shaped drain pipe (4). The cleaning brush (3) is fastened in the cup-like filter plate (2) by means of inserting the pull rod (31) in the center hole (23) of the cup-like filter plate (2) before it is screwed up with the link rod (32) permitting the top head (311) and the lifting ring (312) to be stopped at the center hole (23). When silt and other impurities and sediments are accumulated, clean water is poured in the drain pipe (4) through the strainer (1) and the cleaning brush (3) is pulled and pushed repeatedly by holding fingers on the lifting ring (312) to shake off the silt and other impurities and sediments. Therefore, the passage way of the drain pipe (4) is cleared efficiently and will not be blocked up by the silt, impurities and sediments.

I claim:

1. A floor drain pipe assembly, including:

a S-shaped drain pipe;

a cup-like filter plate having a center hole through its central axis and being mounted on the orifice of said S-shaped drain pipe;

a strainer covered on the top of said cup-like filter plate; and a cleaning brush fastened in said center hole of said cup-like filter plate and comprised of a pull rod, a link rod and an elongated flexible board, said flexible board being of a width substantially equal to the cross-sectional width of the drain pipe, said pull rod having a threaded bottom end, a top head and a lifting ring, said link rod having a bolt hole on the top for the insertion therein of said threaded bottom end and a plurality of side pins at one side for the securing thereto of said elongated flexible board, said elongated flexible board having a plurality of lines of cross-wise arranged projecting strips;

wherein said cleaning brush can be pulled up and pushed down repeatedly to shake off the sediments accumulated thereon and clear the passageway of the said drain pipe.

2. A floor drain pipe assembly as claimed in claim 1, wherein said S-shaped drain pipe includes a bent pipe portion extending from a vertical end pipe portion to define therewith a first bent on its upper side and a second bent on its bottom side, said second bent being arranged at a level much higher than said first bent so that impurities and mud contained in the drain water which flows therein can be retained in the bottom of said vertical end pipe portion and vermins can be prohibited from passing therethrough.

3. A floor drain pipe as claimed in claim 1, wherein the outer diameter of said pull rod is equal to or less than the inner diameter of the center hole of said cup-like filter plate and the diameter of the top head of said pull rod is larger than the inner diameter of said center hole.

* * * * *